US008235875B2

(12) United States Patent
Chen

(10) Patent No.: US 8,235,875 B2
(45) Date of Patent: Aug. 7, 2012

(54) KINETIC DUMBBELL

(75) Inventor: Larry Chen, Taichung County (TW)

(73) Assignee: Ucheer Health Tech Co., Ltd., Taichung County (TW)

( * ) Notice: Subject to any disclaimer, the term of this patent is extended or adjusted under 35 U.S.C. 154(b) by 0 days.

(21) Appl. No.: 12/955,476

(22) Filed: Nov. 29, 2010

(65) Prior Publication Data

US 2012/0040805 A1 Feb. 16, 2012

(30) Foreign Application Priority Data

Aug. 16, 2010 (TW) ..... 99215739 U

(51) Int. Cl.
*A63B 21/22* (2006.01)
*A63B 21/072* (2006.01)
*A63B 22/18* (2006.01)

(52) U.S. Cl. ..... 482/110; 482/44; 482/108

(58) Field of Classification Search ..... 482/44–46, 482/50, 81, 82, 106–110, 131, 132
See application file for complete search history.

(56) References Cited

U.S. PATENT DOCUMENTS 3,311,374 A * 3/1967 Wittenberg et al. ..... 482/106
4,076,236 A * 2/1978 Ionel ..... 482/108
4,605,222 A * 8/1986 Shannon ..... 482/108
4,632,391 A * 12/1986 Orak ..... 482/110
4,903,962 A * 2/1990 Pollack ..... 482/106
4,921,246 A * 5/1990 Hornbostel ..... 482/106
5,250,014 A * 10/1993 Chang ..... 482/106
5,399,135 A * 3/1995 Azzouni ..... 482/106
5,692,944 A * 12/1997 Pellicone ..... 446/170
5,904,640 A * 5/1999 Shahinian ..... 482/110
6,099,444 A * 8/2000 Domenge ..... 482/110
6,179,758 B1 * 1/2001 Domenge ..... 482/110
6,488,613 B1 * 12/2002 Domenge ..... 482/110
6,500,102 B1 * 12/2002 Domenge ..... 482/110
6,752,747 B2 * 6/2004 Yu ..... 482/110
6,837,833 B2 * 1/2005 Elledge ..... 482/108
7,037,243 B1 * 5/2006 Clancy ..... 482/81
7,381,167 B2 * 6/2008 Duhamel ..... 482/108

* cited by examiner

*Primary Examiner* — Loan Thanh
*Assistant Examiner* — Victor K Hwang
(74) *Attorney, Agent, or Firm* — Apex Juris, pllc; Tracy M. Heims

(57) ABSTRACT

A kinetic dumbbell of the present invention includes a handle and two weight devices connected to opposite ends of the handle. Each of the weight devices has an annular channel and at least a ball received in the annular channel. The balls are running in the endless annular channels to provide an extra vibration effect while training with the kinetic dumbbell of the present invention.

7 Claims, 10 Drawing Sheets

KINETIC DUMBBELL

BACKGROUND OF THE INVENTION

1. Field of the Invention

The present invention relates generally to a training apparatus, and more particularly to a kinetic dumbbell.

2. Description of the Related Art

Conventional dumbbells for training usually are a single element with a constant weight. User has to buy many dumbbells of different weights for different trainings. Besides, conventional dumbbells are used for arm training only that user may lose interest in using the dumbbells soon after some time of use.

To overcome the drawbacks above, a swing-type dumbbell which provides an extra vibration effect in training is presented in the market. Such dumbbell, as taught in Taiwan Utility Model Patent No. M376318, includes a tubular handle, some counterweights and springs received in the handle, and two lids closing opposite ends of the handle. The counterweights are reciprocating in the handle to compress the springs to provide vibration effect when user holds and moves the dumbbell.

However, when the counterweights are reciprocating, they impact the lids on opposite sides of the handle and make them or one of them drop off. As the lid uncovers the handle, the counterweights and springs in the handle may go off from the handle, and the counterweights might hurt somebody. In conclusion, the swing-type dumbbell still has some drawbacks to improve.

SUMMARY OF THE INVENTION

The primary objective of the present invention is to provide a kinetic dumbbell to provide an extra vibration effect in training.

The secondary objective of the present invention is to provide a kinetic dumbbell whose weight may be adjusted for different trainings.

To meet the primary objective, a kinetic dumbbell includes a handle, at least a weight device connected to the handle, wherein the weight device has at least an annular channel therein, and at least a rolling device received in the annular channel for free running.

In an embodiment, there are two or more weight devices serially connected to change weight of the kinetic dumbbell of the present invention, and each weight device has the annular channel and the rolling device therein.

DETAILED DESCRIPTION OF THE INVENTION

Figure 1:
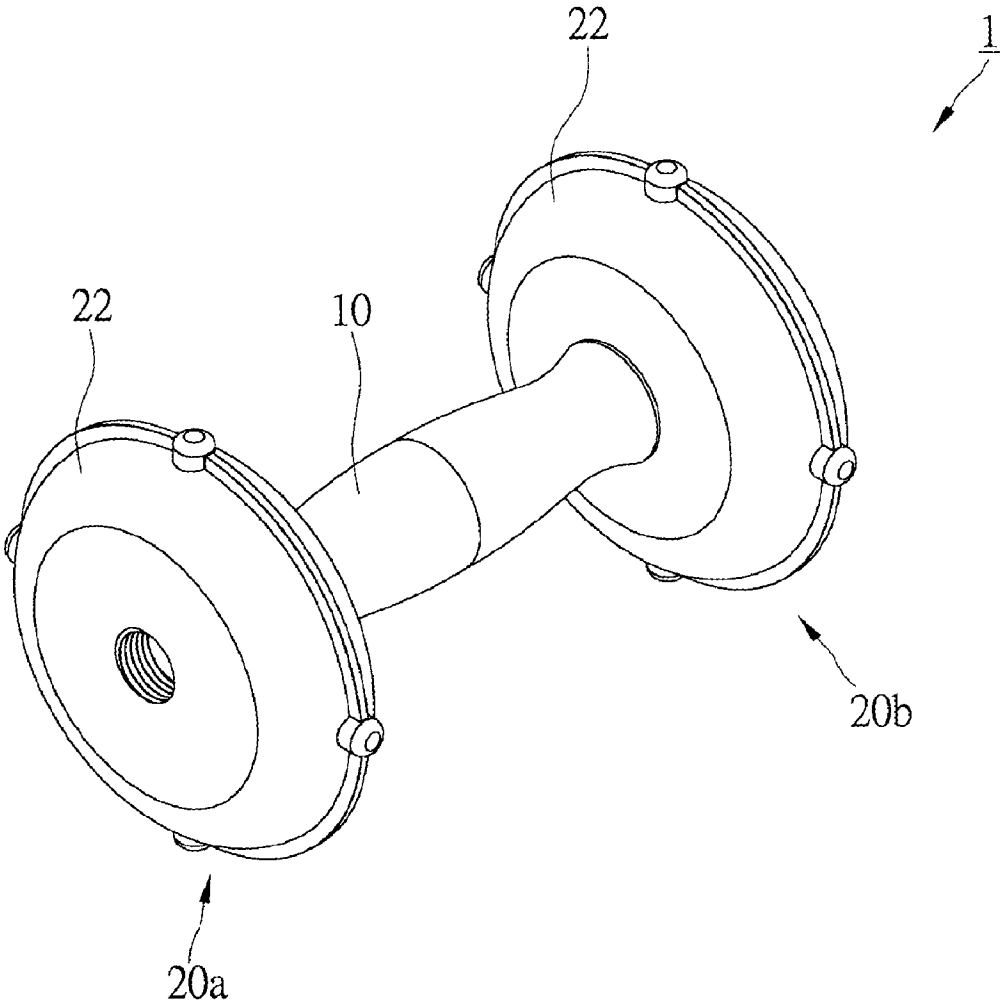
FIG. 1 is a perspective view of a first preferred embodiment of the present invention.
Figure 2:
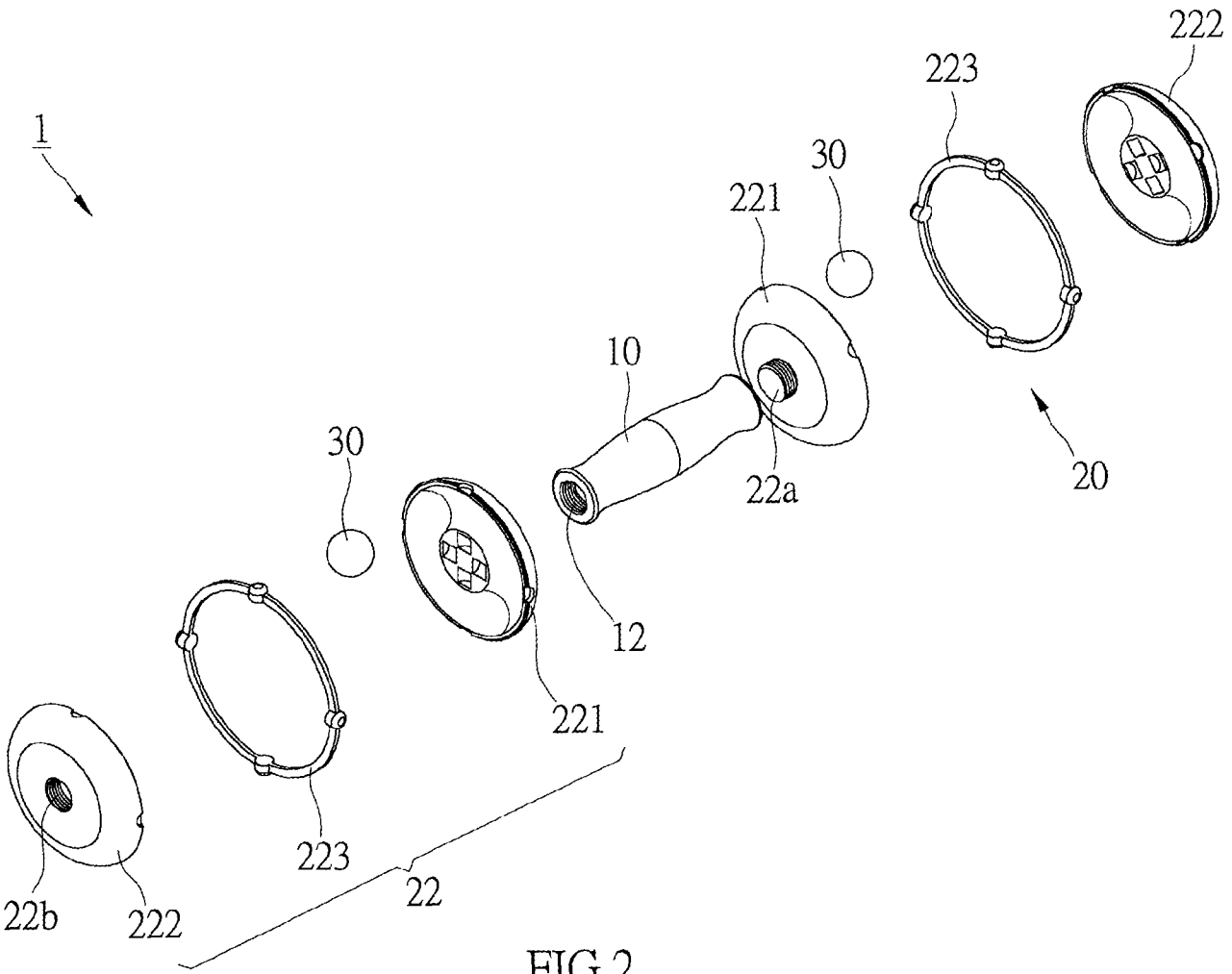
FIG. 2 is an exploded view of the first preferred embodiment of the present invention.

As shown in FIG. 1 and FIG. 2, a kinetic dumbbell 1 of the first preferred embodiment of the present invention includes a handle 10, two weight devices 20 and a rolling device 30.

The handle 10 is a bar having two connecting portions 12 at opposite ends. In the present embodiment, the connecting portions 12 have threaded holes. The handle 10 has a curved surface that user may hold the handle 10 firmly while training.

Figure 3:
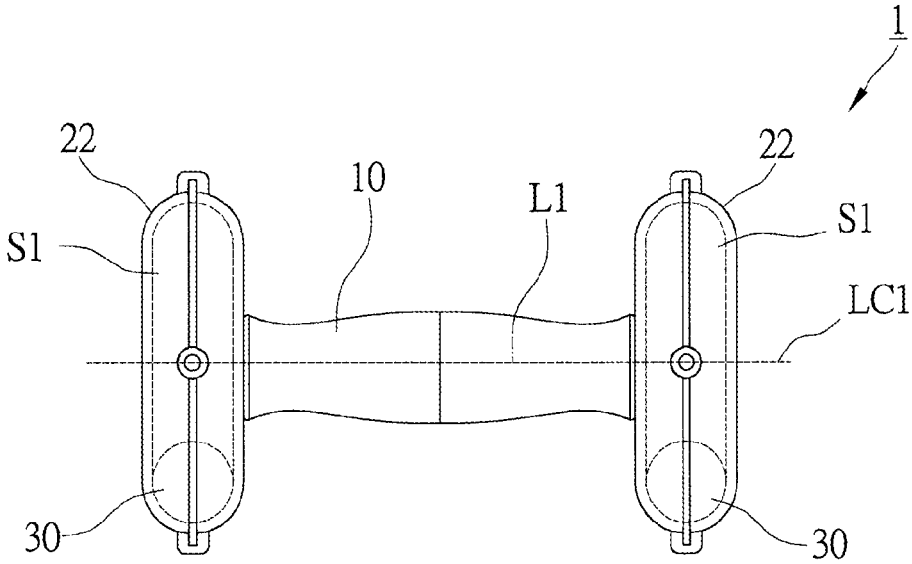
FIG. 3 is a front view of the first preferred embodiment of the present invention.
Figure 4:
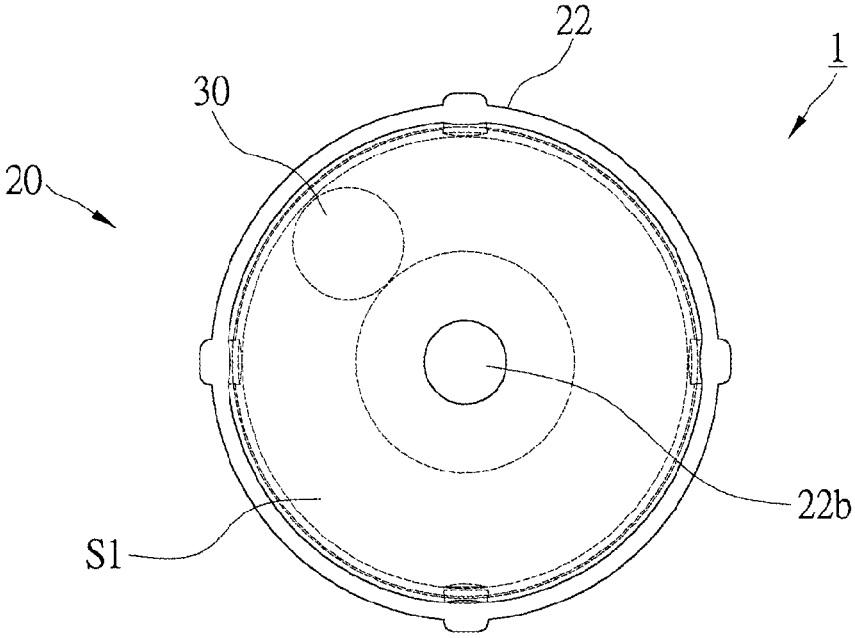
FIG. 4 is a lateral view of the first preferred embodiment of the present invention.

The weight devices 20, including a first weight device 20*a* and a second weight device 20*b*, are connected to the opposite ends of the handle 10. Each weight devices 20*a*, 20*b* has a first kinetic member 22. The first kinetic member 22 has a first case 221, a second case 222 and a rubber pad 223. As shown in FIG. 3 and FIG. 4, the first and second cases 221, 222 are connected together to form an annular channel S1 therein. A center axis LC1 of the annular channel S1 and an axis L1 of the handle are at the same line.

Figure 5:
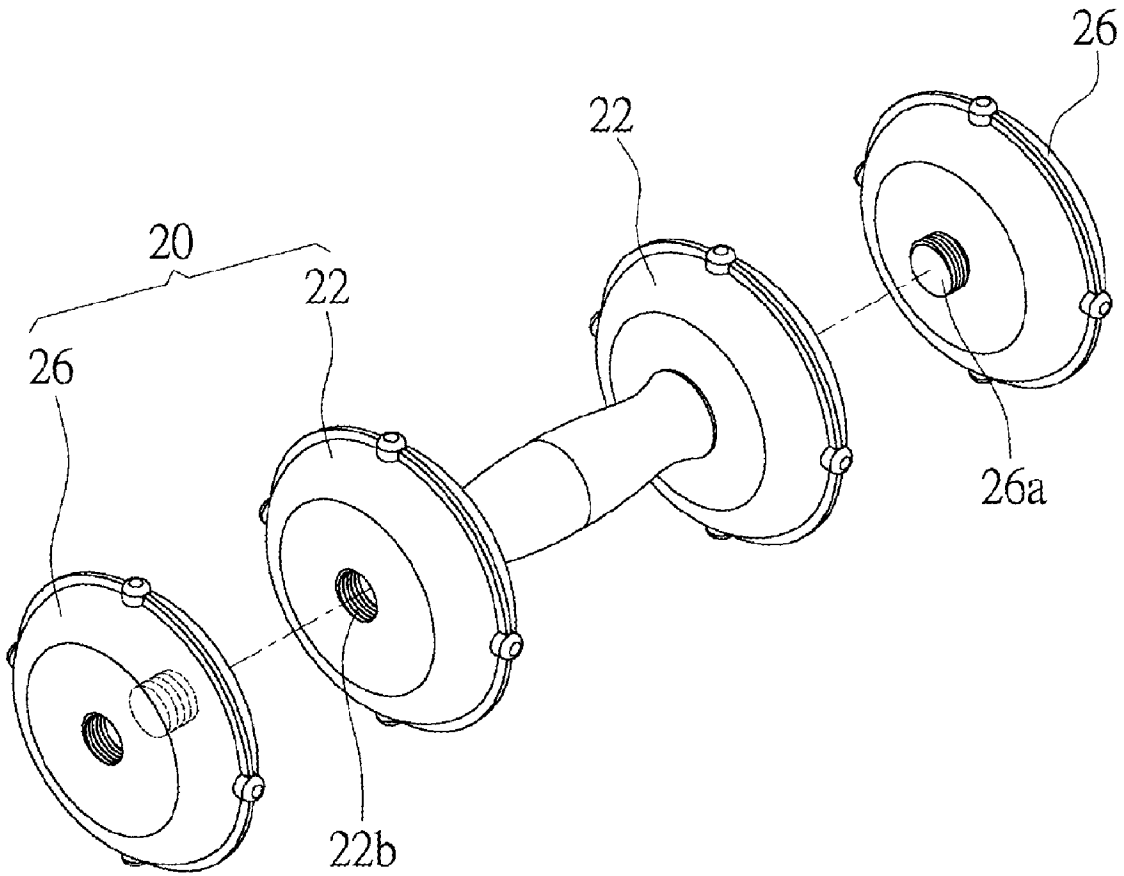
FIG. 5 is a perspective view of the first preferred embodiment of the present invention, showing how to increase weight.

The first case 221 has a connecting portion 22*a*, which is a threaded post in this embodiment, to be engaged with the threaded hole 12 of the handle 10. The second case 222 is provided with a threaded hole 22*b* that a second kinetic member 26 may be connected to the first kinetic member 22 by a thread post 26*a* of the second kinetic member 26 engaged with the threaded hole 22*b* of the first kinetic member 22 as shown in FIG. 5 to increase the weight of the dumbbell 1 of the present invention for different levels of training. It is noted that the number of the kinetic members to be serially connected is unlimited.

The rubber pad 223 is a ring between the first case 221 and the second case 222. An outer side of the rubber pad 223 is left out of the cases 221, 222 to protect the cases 221, 222 from breaking when the dumbbell 1 drops to the floor. Besides, the rubber pad 223 may provide dumbbell 1 of the present invention a fancy look.

Figure 6:
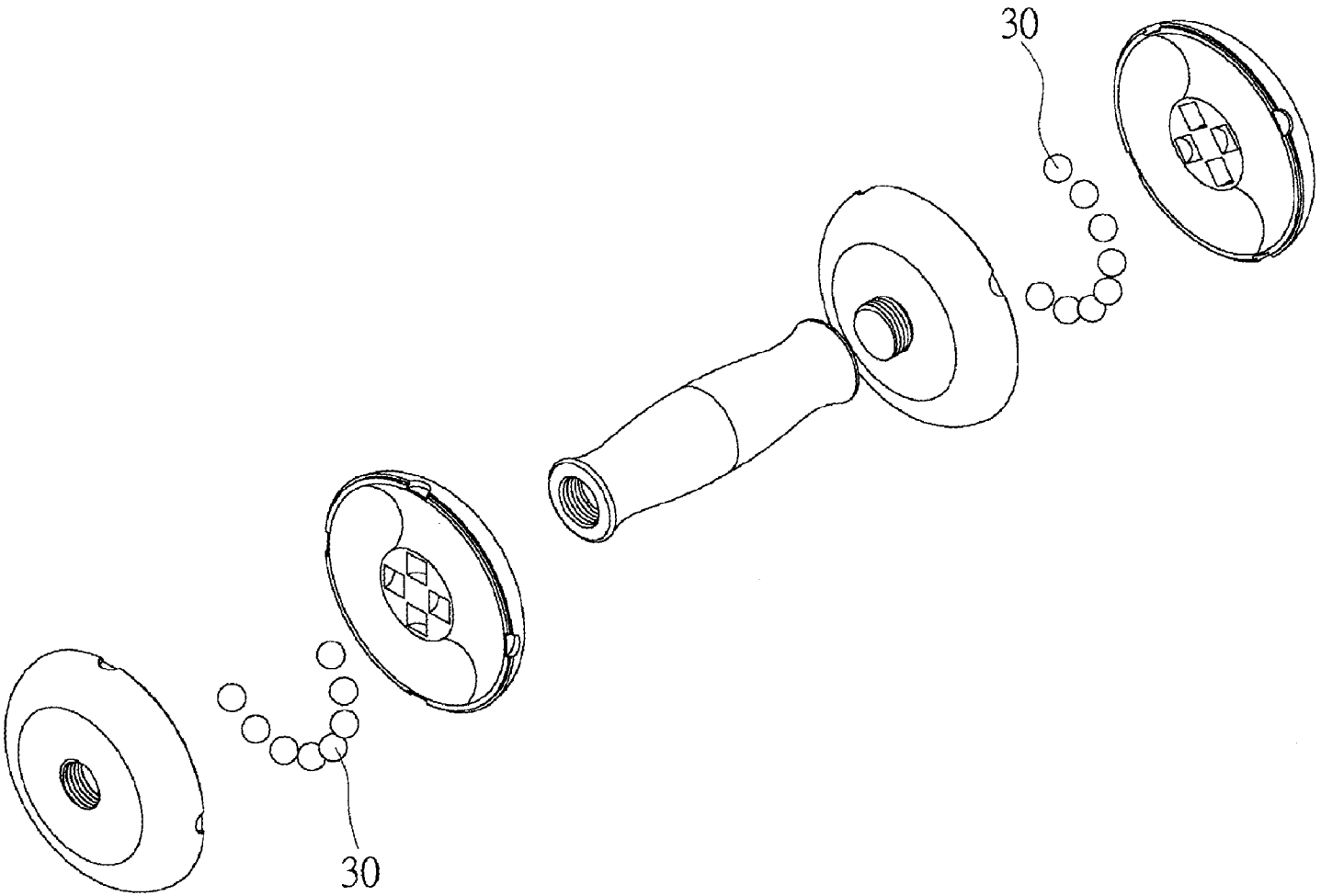
FIG. 6 is an exploded view of the first preferred embodiment of the present invention, showing the balls for the rolling devices.

The rolling device 30 has two balls received in the annular channels S1 of the first and the second weight devices 20*a*, 20*b* respectively. The rolling device 30 may be added with more balls, as shown in FIG. 6, to be received in the weight devices 20*a*, 20*b* as the user or designer wants. The rolling device 30, except for the balls, may be rollers, wheels, pins or other relative devices.

Figure 7:
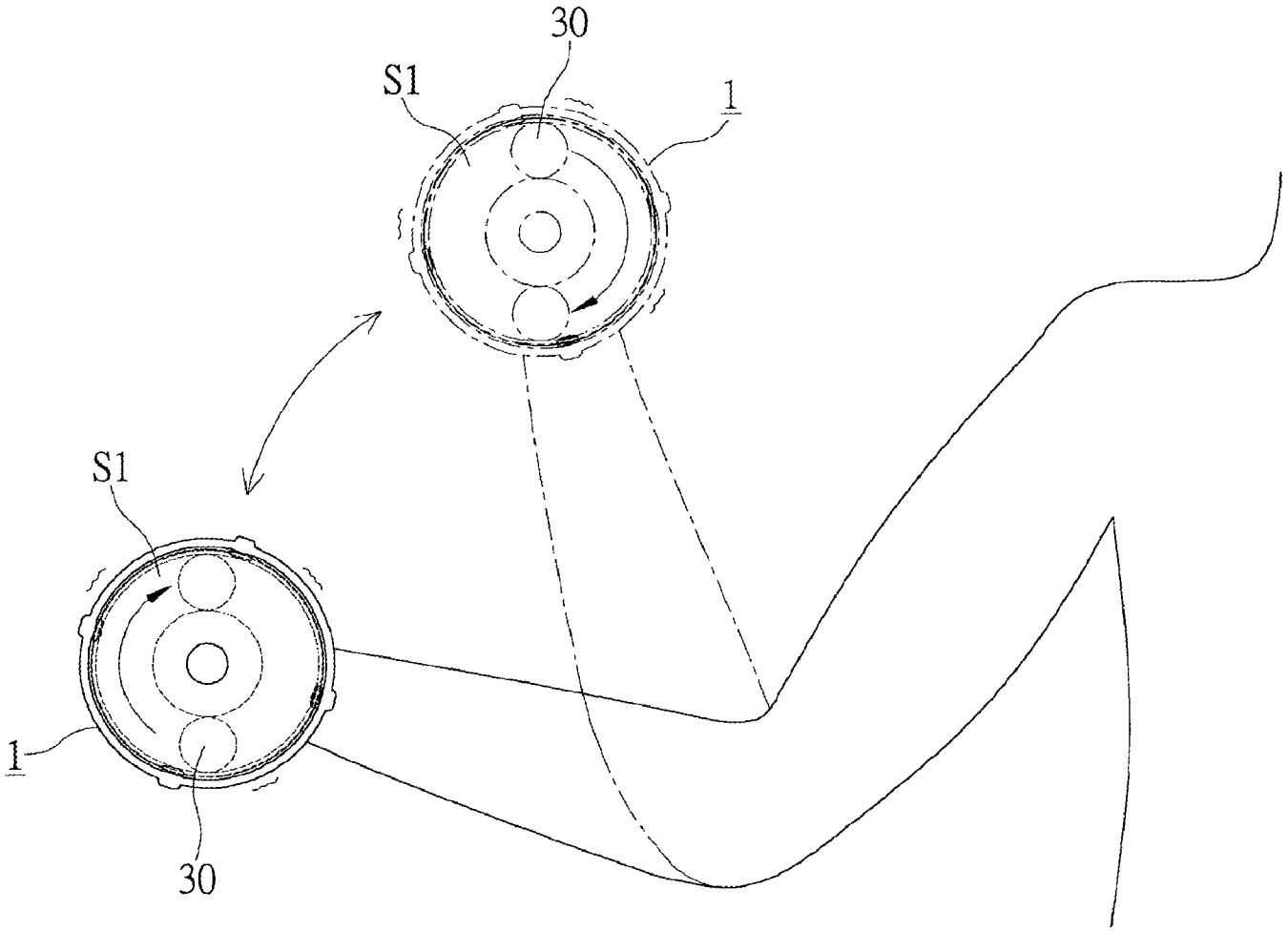
FIG. 7 is sketch diagram of the first preferred embodiment of the present invention, showing how user uses the dumbbell of the present invention.

As shown in FIG. 7, in exercise with the dumbbell 1 of the present invention, the user holds the handle 10 and swings it repeatedly that the balls 30 will roll in the annular channels S1. The running balls provide vibration to the user's hand that the user has to increase his/her strength to hold the dumbbell 1 to keep the exercise going. Besides, the vibration may massage the user's hand. The annular channel S1 provides an endless path for balls 30 to roll that the present invention will not have the same drawback of the conventional device with reciprocating balls.

Figure 8:
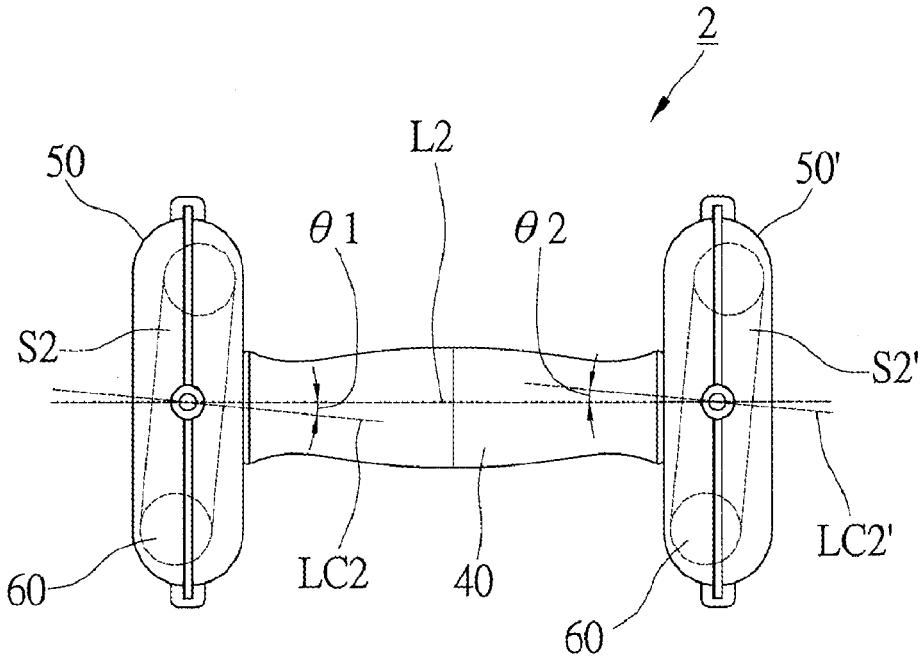
FIG. 8 is a front view of a second preferred embodiment of the present invention.

FIG. 8 shows a kinetic dumbbell 2 of the second preferred embodiment of the present invention, in which weight devices 50, 50*a* have an annular channel S2, S2' therein respectively. Center axes LC2 and LC2' of the weight devices 50, 50*a* are tilted to an axis L2 of a handle 40. A tilting angle between the center axis LC2 and the axis L2 is θ1 and a tilting angle between the center axis LC2' and the axis L2 is θ2. Referring to FIG. 8, the annular channel S2 of the weight device 50 is parallel to the annular channel S2' of the weight device 50' that θ1 is equal to θ2. Balls 60 running in the tilted annular channel S2 and S2' will provide a different feeling while training.

Figure 9:
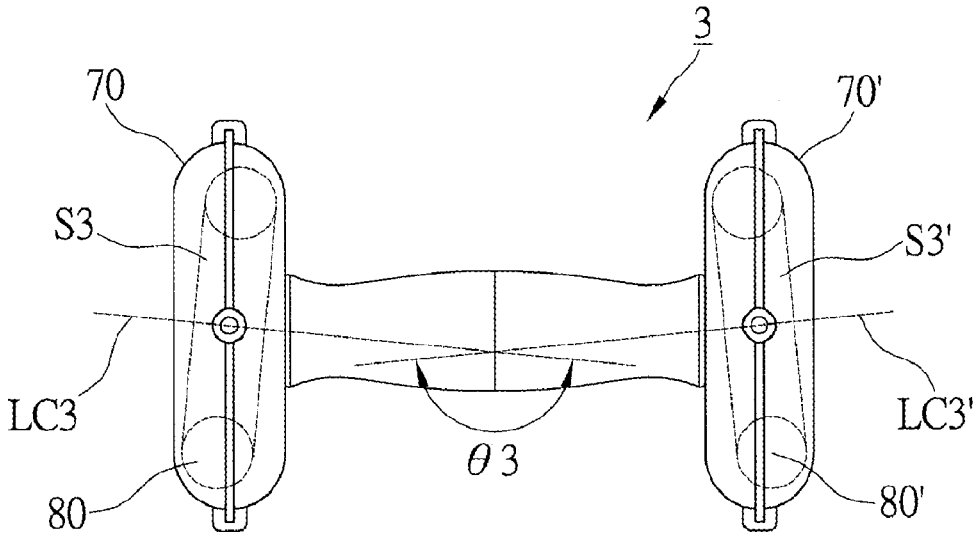
FIG. 9 is a front view of a third preferred embodiment of the present invention.

FIG. 9 shows a kinetic dumbbell 3 of the third preferred embodiment of the present invention, in which annular channels S3 and S3' of the weight devices 70 and 70' are not parallel, which means there is a tilting angle θ3 between center axes LC3 and LC3' of the annular channels S3 and S3' that balls 80' and 80' run in unbalance paths in the weight devices 70 and 70' to provide another different feeling while training.

Figure 10:
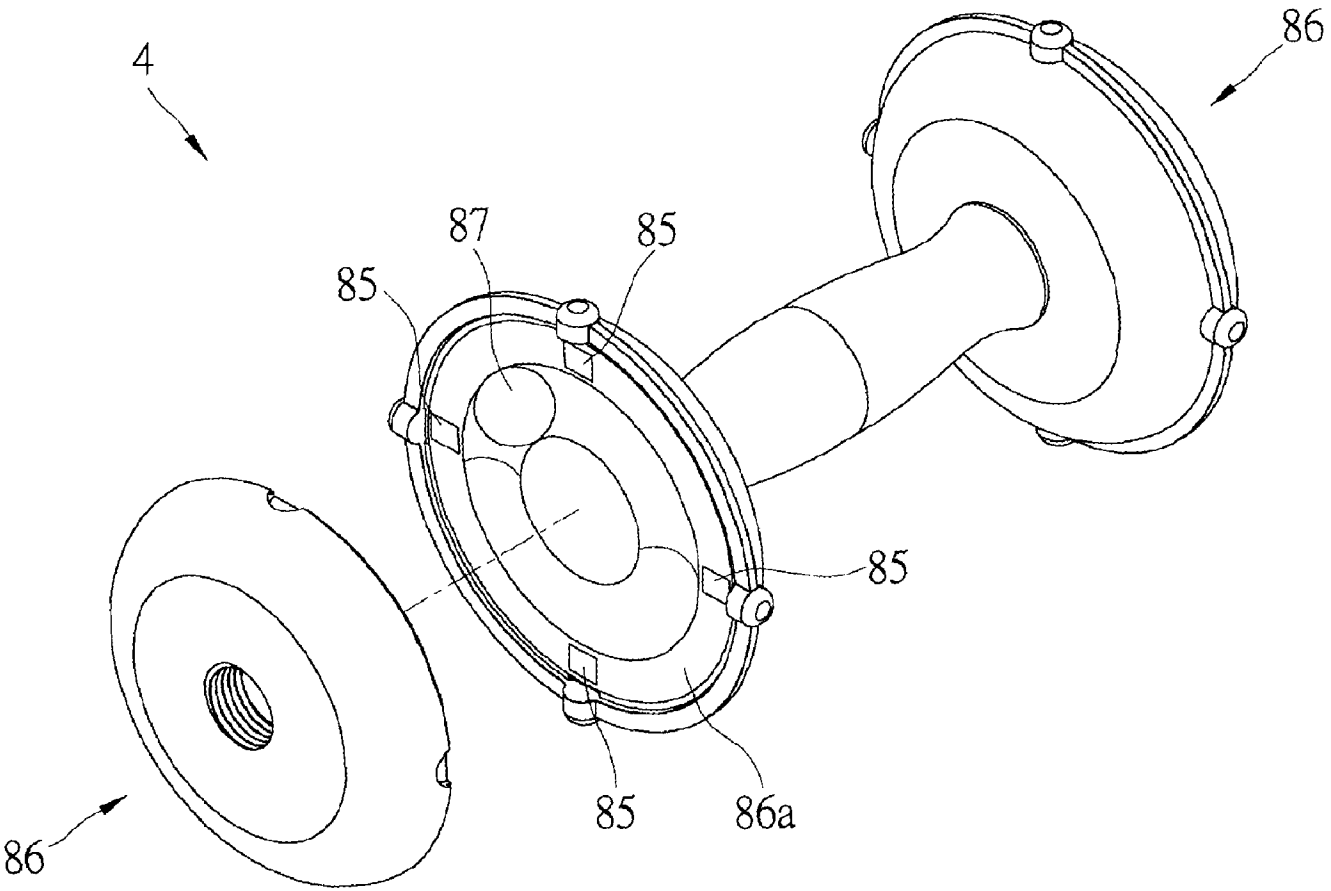
FIG. 10 is a partial exploded view of a fourth preferred embodiment of the present invention.

As shown in FIG. 10, a kinetic dumbbell 4 of the fourth preferred embodiment of the present invention includes a plurality of magnetic members 85 mounted on cases 86*a* of weight devices 86 respectively. Balls 87 running in annular channels of the weight devices 86 will be attracted by the magnetic members 85 to change the speeds and accelerations of the balls 87.

Figure 11:
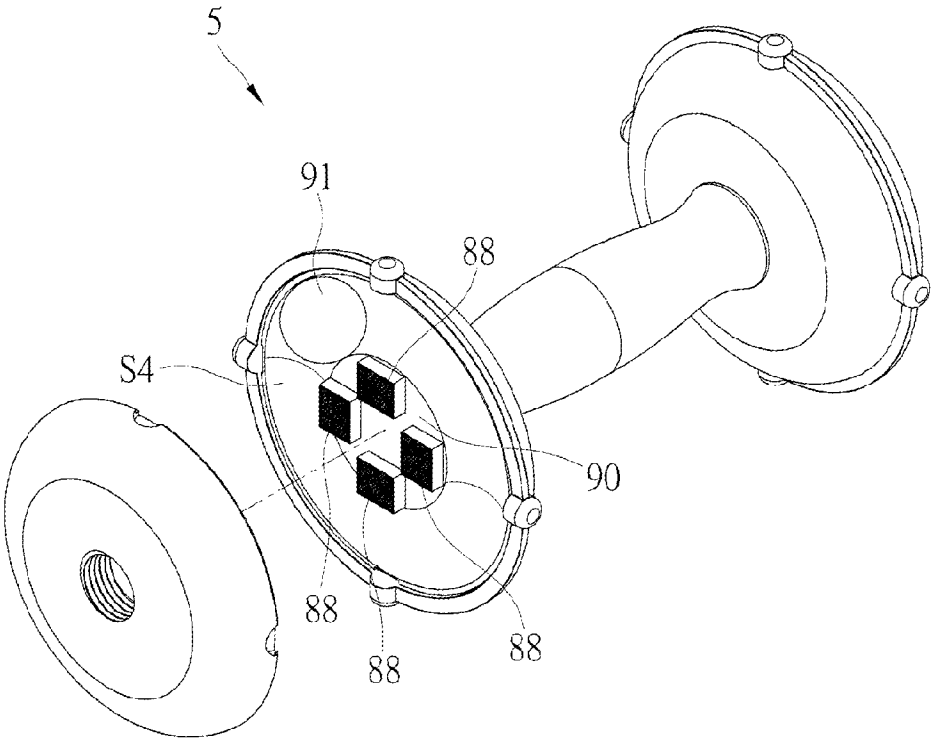
FIG. 11 is a partial exploded view of a fifth preferred embodiment of the present invention.

FIG. 11 shows a kinetic dumbbell 5 of the fifth preferred embodiment of the present invention, in which magnetic members 88 are received in chambers 90 in weight devices. The chambers 90 are located at centers of annular channels S4. Cases of the weight devices may be provided with several recesses in the chambers 90 to mount the magnetic members 88 therein.

Figure 12:
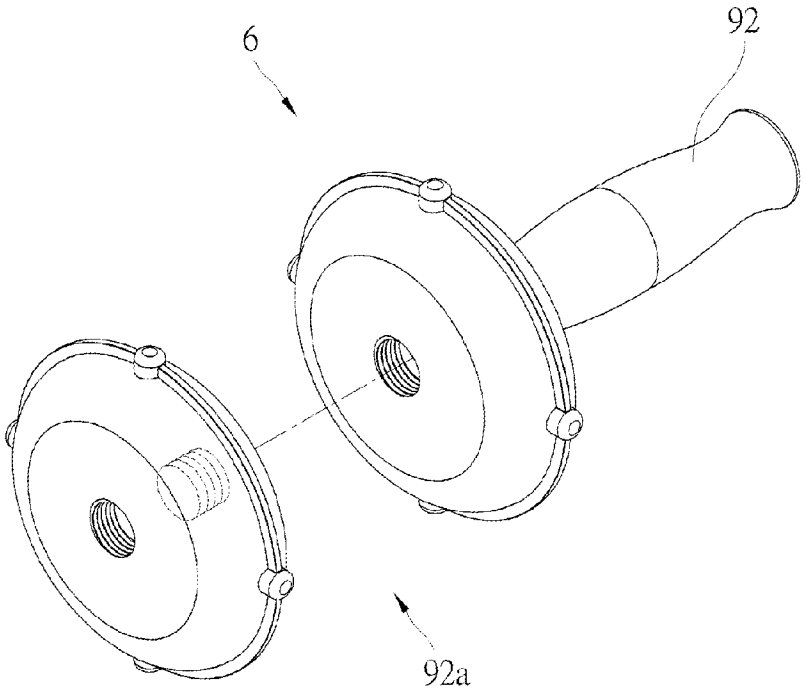
FIG. 12 is a perspective view of a sixth preferred embodiment of the present invention

As shown in FIG. 12, a kinetic dumbbell 6 of the fifth preferred embodiment of the present invention only provides one weight device 92*a* mounted at an end of a handle 92. The kinetic dumbbell 6 provides an unbalanced weight distribution that user may have different training effects with the kinetic dumbbell 6 of the present invention. It is noted that the different types of the weight devices disclosed in the embodiments of the present invention may be used in the kinetic dumbbell, or it can also be a combination of two or more types of the weight devices used in the kinetic dumbbell of the present invention.

In conclusion, the kinetic dumbbell of the present invention provides an extra vibration effect in training, and furthermore, the weight may be adjusted for different levels of training. The present invention may further avoid the problem of the conventional device for having the reciprocating balls damaging the handle.

The description above is a few preferred embodiments of the present invention and the equivalence of the present invention is still in the scope of claim construction of the present invention.

What is claimed is:

1. A kinetic dumbbell, comprising:

a handle;

at least a first weight device connected to the handle, wherein the first weight device has at least an annular channel therein;

at least a rolling device received in the annular channel for free running;

wherein the handle is connected with two of the first weight devices at opposite ends thereof;

wherein a first angle is formed between an axis of the handle and a center axis of the annular channels of a first one of the first weight devices and a second angle is formed between the handle and a center axis of the annular channels of a second one of the first weight devices; and wherein the first angle is unequal to the second angle.

2. The kinetic dumbbell as defined in claim 1, wherein the handle has a connecting portion at an end thereof, and the weight device has a kinetic member with the annular channel therein and a connecting portion to be engaged with the connecting portion of the handle.

3. The kinetic dumbbell as defined in claim 2, wherein the kinetic member has a first case and a second case, and the connecting portion is provided on the first case, and the annular channel is formed between the first case and the second case.

4. The kinetic dumbbell as defined in claim 1, further comprising a second weight device connected to the first weight device.

5. The kinetic dumbbell as defined in claim 4, wherein each of the weight devices has a post and a hole at opposite sides thereof for series connection.

6. A kinetic dumbbell, comprising:

a handle;

at least a weight device connected to the handle, wherein the weight device has at least an annular channel therein; and at least a rolling device received in the annular channel for free running; and further comprising at least a magnetic member mounted in a chamber of the weight device to attract the rolling device.

7. A kinetic dumbbell, comprising:

a handle;

at least a weight device connected to the handle, wherein the weight device has at least an annular channel therein; and at least a rolling device received in the annular channel for free running; and further comprising at least a magnetic member mounted in a chamber of the weight device to attract the rolling device, wherein the chamber is located at a center of the annular channel.

* * * * *